United States Patent [19]

Labbe et al.

[11] 3,957,062

[45] May 18, 1976

[54] CIGARETTE MAKING MACHINES

[75] Inventors: Francis Auguste Maurice Labbe, Neuilly-sur-Seine, France; Brian A. Hodsall; Edward George Preston, both of London, England

[73] Assignee: Molins Limited, London, England

[22] Filed: June 24, 1974

[21] Appl. No.: 482,130

[30] Foreign Application Priority Data

June 29, 1973 United Kingdom ..... 30997/73

[52] U.S. Cl. ..... 131/84 B

[51] Int. Cl.[2] ..... A24B 5/04; A24B 5/08

[58] Field of Search ..... 13/8, 84 B, 84 C

[56] References Cited

UNITED STATES PATENTS

| | | | |
|---|---|---|---|
| 1,559,322 | 10/1925 | Hohn | 131/8 RX |
| 1,829,559 | 10/1931 | Gilliam | 131/8 R |
| 3,034,514 | 5/1962 | Pinkham | 131/84 B |
| 3,039,473 | 6/1962 | Schubert | 131/84 C |
| 3,094,127 | 6/1963 | Gamberini | 131/84 BX |
| 3,297,040 | 1/1967 | Gamberini | 131/84 C |
| 3,563,249 | 2/1971 | Geyer et al. | 131/84 B |
| 3,736,941 | 6/1973 | Molins et al. | 131/84 BX |
| 3,779,252 | 12/1973 | Brackmann et al. | 131/84 B |

FOREIGN PATENTS OR APPLICATIONS

| | | | |
|---|---|---|---|
| 900,182 | 12/1953 | Germany | 131/84 B |
| 1,086,663 | 5/1967 | United Kingdom | 131/84 B |
| 957,317 | 5/1964 | United Kingdom | 131/84 C |

*Primary Examiner*—Robert W. Michell
*Assistant Examiner*—V. Millin
*Attorney, Agent, or Firm*—John C. Smith, Jr.

[57] ABSTRACT

A cigarette making machine for making cigarettes containing a core of material different from that of a surrounding annulus of tobacco comprises a conveyor, a conveyor band for forming a continuous substantially flat initial layer of tobacco on the conveyor, a further conveyor band for feeding a core onto the initial layer of tobacco, side walls for at least partially confining the sides of the core along a predetermined distance after the core has been fed onto the initial layer of tobacco, and a shower for feeding tobacco onto side portions of the initial layer, on opposite sides of the core, while the core is being confined by the side walls.

14 Claims, 9 Drawing Figures

FIG. 6.
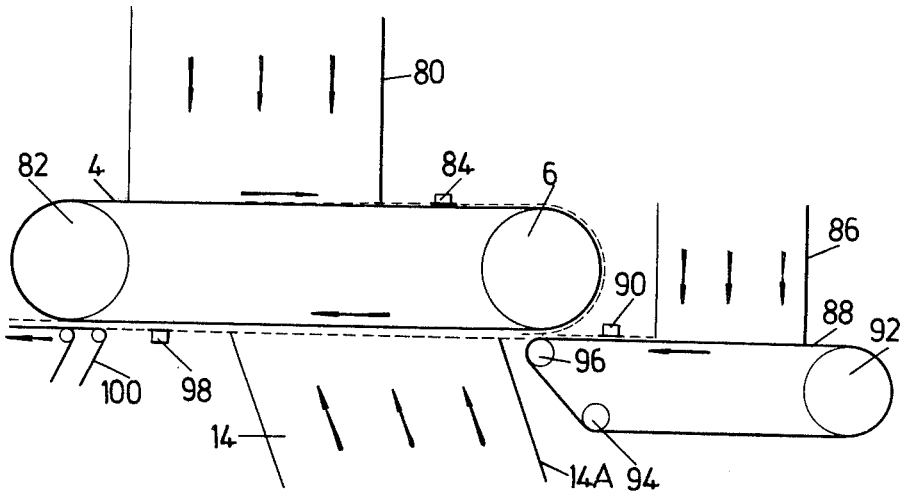
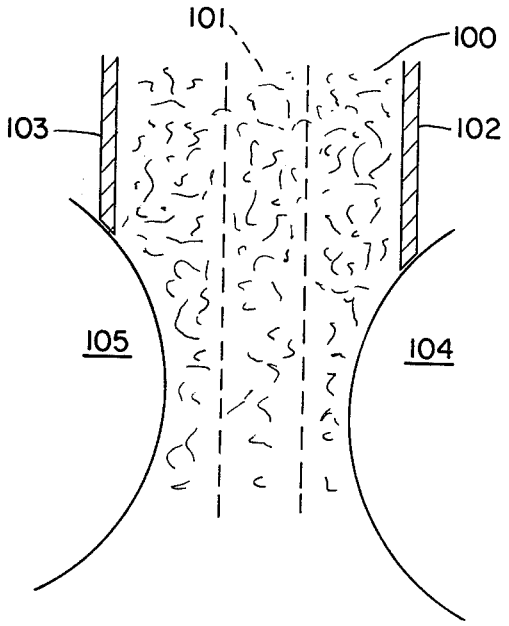
FIG. 9

CIGARETTE MAKING MACHINES

This invention is concerned with a number of modifications or improvements of the inventions described in British Pat. specification No. 1,305,900 and U.S. Pat. application Ser.No. 292,200, filed Sept. 25, 1972. That is to say, it is concerned with making a cigarette with a core of material different from a surrounding annulus of tobacco.

In this context it should be understood that the term "tobacco" is intended to include materials other than tobacco which may be used in cigarettes, or tobacco mixed with such materials. For example, the annulus of tobacco may comprise a blend of tobacco and artificial tobacco, while the core within this annulus may, for example, have a larger proportion of artificial tobacco or may be purely of artificial tobacco or of some other smokable material, possibly woven or extruded into a coherent rope.

The above-mentioned patent and application describe arrangements in which the core is fed into a U-sectioned first layer of tobacco. According to one aspect of the present invention, on the other hand, a cigarette making machine for making the above-mentioned core-centered cigarettes comprises means for forming a continuous substantially flat initial layer of tobacco on a conveyor, means for feeding a core onto the initial layer of tobacco, side walls for at least partially confining the sides of the core along a predetermined distance after the core has been fed onto the initial layer of tobacco, and means for feeding tobacco onto side portions of the initial layer, on opposite sides of the core, while the core is being confined by the side walls.

According to a further aspect of this invention, a core may be plunged into a uniform-thickness layer of tobacco so that the tobacco layer is formed into a U shape by the plunging in of the core.

According to another aspect of this invention, a U-sectioned layer of tobacco is formed by showering or feeding a stream of tobacco onto a suction wheel having a central circumferential rib forming a groove in the tobacco stream for the receipt of the core. Preferably the tobacco stream is trimmed while on the wheel and is then placed on a further conveyor to expose the groove so that the core can be inserted. The cigarette filler stream is then completed by showering or feeding tobacco on to the first layer of tobacco and over the core.

Examples of machines according to this invention are shown in the accompanying drawings. In these drawings:

FIG. 6 is a diagrammatic side view of a complete machine including the parts shown in FIGS. 1 and 2;

FIG. 9 is a plan view of a further embodiment of the invention.

Figure 1:
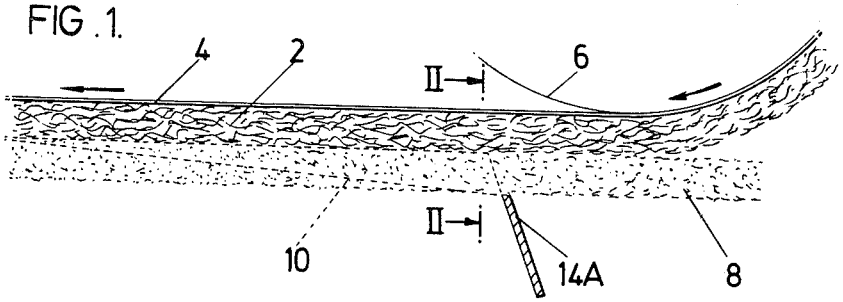
FIG. 1 is a diagrammatic fragmentary sectional view from the side of one machine.

FIG. 1 shows part of a machine which is shown more completely in FIG. 6. A flat layer of tobacco 2 is formed by showering tobacco downwards through a chute 80 and towards a suction band 4. After receiving this tobacco the band passes around a pulley 6. The arrangement is generally similar to that shown in FIG. 9 of British Pat. specification No. 1,305,900, but the initial tobacco layer 2 in the present case is not formed into a U shape as in the patent specification, but remains flat in cross section between spaced rails 14 and 16 extending transversely from the tobacco supporting surface of the band 4.

A core of compressed particulate material 8 is fed along and below the tobacco layer 2, initially between fixed side walls 10 and 12 which confine the sides of the core. These side walls start adjacent to an end wall 14A of a chimney 14 with a height sufficient to accommodate the entire height of the core stream 8, and then progressively taper away to nothing along about 38 to 50 mm of the path of the core. That is to say, lower edges 10B, 12B, of the side walls converge towards upper edges 10A, 12A, which are parallel to the band 4 and are spaced from the band so as to allow the tobacco layer 2 to pass above them.

The core is formed by showering core material downwards through a chute 86 onto a band 88 which passes around pulleys 92, 94 and 96 as shown in FIG. 6. The core stream thus formed is trimmed by a trimming device 90 before being fed onto the tobacco layer 2.

While the core stream is being guided between the side walls 10 and 12, tobacco is showered upwards through the chimney 14 and into spaces 16 and 18 and to some extent also over the core. This tobacco may, for example, be comparatively short to enable it to enter the relatively narrow spaces 16 and 18. Then during further movement of the band with the core, further tobacco is showered through the chimney to surround the core in an annulus of tobacco as in the patent specification. A trimming device 98 then removes part of the last showered tobacco and the trimmed stream is then enclosed in a continuous wrapper web 100 in a known manner.

FIG. 6 shows a trimmming device 84 for removing part of the tobacco showered onto the band 4 through the chute 80. This trimming device may be omitted if desired.

Figure 2:
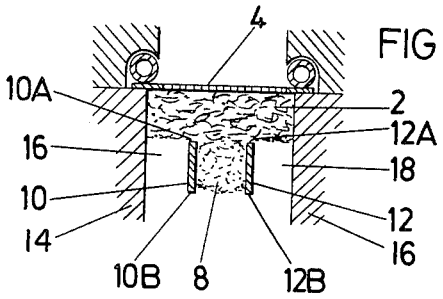
FIG. 2 is a section on the line II—II in FIG. 1.
Figure 3:
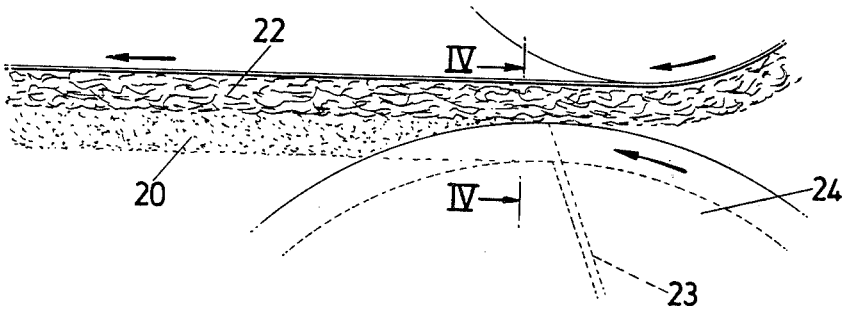
FIG. 3 is a diagrammatic fragmentary sectional view from the side of a different machine.
Figure 4:
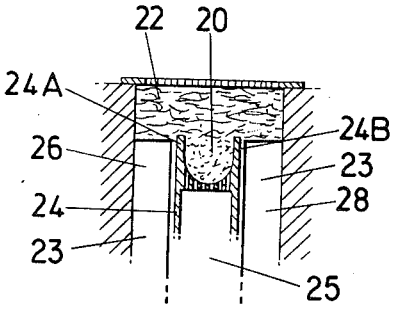
FIG. 4 is a section on the line IV—IV in FIG. 3.

FIGS. 3 and 4 show a modification of the arrangement of FIGS. 1 and 2. In this example the core stream 20 is carried onto an initial flat layer of tobacco 22 in a peripheral groove of a wheel 24. Flange portions 24A and 24B defining the groove serve to confine the sides of the core stream for a short way while an initial quantity of tobacco is showered upwards through a chimney similar to that shown in FIG. 6, an end wall of which is shown at 23, into spaces 26 and 28 on opposite sides of the core stream, as in the previous example. The wheel 24 which is narrower than the chimney passes through a slot 25 in the end wall 23 of the chimney. The core stream 20 may be formed by showering core material onto a band (as in FIG. 6) and then transferring the core stream to the wheel 24.

Figure 5:
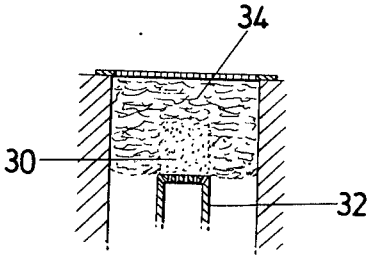
FIG. 5 is a sectional view showing another different arrangement.

FIG. 5 shows a core stream 30 being carried by means of suction on the rim of a wheel 32 and being pressed into a relatively thick tobacco layer 34, thus deforming the tobacco layer into a U-shaped cross-section. The tobacco layer may be formed as in FIG. 6.

The sides of the core are confined by fixed side walls similar to side walls 10 and 12 shown in FIG. 2 which terminate just as the core enters the tobacco layer 34. The cigarette filler stream is completed, as before, by showering further tobacco over the tobacco 34 and core 30.

In the examples described above, the core stream, at the stage where it is fed onto the initial tobacco layer, is preferably compressed so that it is at substantially its final density in the finished cigarette. Alternatively, however, the core may be fed on to the initial layer of tobacco as a somewhat less firmly compacted stream, for example at about two thirds its final density. In that case the width of the core stream is preferably greater than the depth, and the width of the completed filler (before it is fed into the garniture or other mechanical compressing device) is preferably greater than the depth. For example, the ratio of width to height in each case may be 12:10. The filler stream is then preferably compressed sideways to reduce the width to approximately the dimension of the height just before the filler stream enters a garniture. Referring to FIG. 9, the initially less dense filler stream 100, including the core 101, is fed along a path between side rails 102 and 103, similar to side rails 14 and 16 in FIG. 2, and between two wheels 104 and 105 rotating about vertical axes on opposite sides thereof. The filler stream is compressed sideways by the peripheral surfaces of the two wheels, the opposing peripheral surfaces of which are closer to each other than the corresponding surfaces of rails 102 and 103. Alternatively, two converging side bands may be used in place of wheels 104 and 105.

Instead of the initial layer of tobacco being formed into a U-section to confine the sides of the core stream, it may be kept flat and the core stream may be fed onto it together with two streams of tobacco lying on opposite sides of the core stream. For example, the core stream and the two side tobacco streams may be fed on to a wheel like the wheel 24 in FIG. 4, except that the wheel would be as wide as the initial tobacco layer 22.

Figure 7:
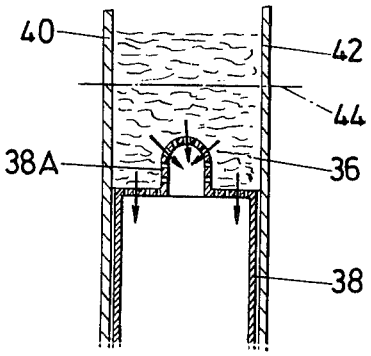
FIG. 7 is a sectional view showing the formation of a U-sectioned layer of tobacco in a different way.

FIG. 7 shows a U-sectioned tobacco layer 36 being formed on a suction wheel 38 which has an air-pervious rim including a central peripheral rib portion 38A. The wheel runs between fixed walls 40 and 42, tobacco being for example showered on to the wheel through a channel defined by the walls 40 and 42. A surplus amount of tobacco is showered or otherwise fed on to the wheel 38 to enable the thickness and density at the middle to be precisely determined by trimming the tobacco stream at a line 44. After trimming, the U-sectioned tobacco layer is preferably placed on a band so that the groove defined by the rib portion 38A of the wheel faces outwards and can receive a core. The cigarette filler stream is then completed by showering or feeding further tobacco over the first layer and core.

Figure 8:
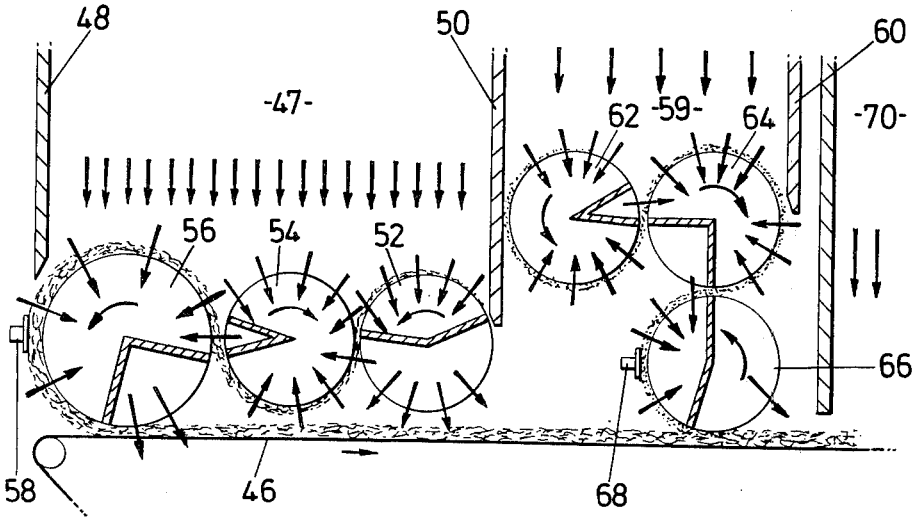
FIG. 8 shows how the initial tobacco layer and core of FIG. 7 may be formed.

FIG. 8 shows a machine including the arrangement of FIG. 7. Tobacco is showered downwards towards a suction band 46 through a channel 47 having end walls 48 and 50. Above the band 46 there are three wheels 52, 54 and 56 which rotate in the directions shown. The wheels are hollow and have suction applied to selected segments as indicated by the inwardly directed air flow arrows; the outwardly directed arrows extend from spaces in the wheels which are at atmoserphic or slightly above atmospheric pressure.

A layer of tobacco is built up on the upper half of the wheel 52 and this is transferred to the wheel 54, which already carries a similar layer built up from the tobacco showered on to the upper half of the wheel 54. Thus a double-thickness layer of tobacco is delivered by the wheel 54 to the wheel 56, and further tobacco is showered on to the upper half of the wheel 56 to add to this tobacco layer. To the left of the wheel 56 there is a trimmer 58 which trims the tobacco layer on the wheel 56, that is to say at the line 44 shown in FIG. 7, after which the tobacco stream is placed on the band 46. The wheel 56 is similar to the wheel 38 in FIG. 7 in having a central peripheral rib forming a groove for the receipt of a core.

The core is formed by showering particulate core material downwards through a channel 59 of which the end walls are the wall 50 and a wall 60. The core material lands on the upper halves of two wheels 62 and 64. A layer of tobacco builds up initially on wheel 62 and this is transferred to the wheel 64, which carries the core stream clockwise while further core material is showered on to it to increase the thickness of the core stream which is then transferred to a wheel 66. A trimmer 68 trims away part of the core stream to form a substantially uniform stream which is then placed in the groove of the tobacco stream. Further tobacco is then showered through a channel 70 to complete the cigarette filler stream. Part of this final tobacco layer is preferably trimmed away by means of a trimmer (not shown) situated above the band 46 immediately after the channel 70. The cigarette filler stream on the band 46 may then be transferred to a wrapper web, for example by means of a large wheel which carries the stream generally upwards, and then by means of a suction band which receives the filler stream from the large wheel and carries it on to the wrapper web.

In all the above examples the core is a stream of particulate material. As an alternative, it could be a coherent pre-formed rod or rope or a series of spaced rod or rope sections.

We claim:

1. A cigarette making machine for making cigarettes containing a core of material different from that of a surrounding annulus of tobacco, comprising a conveyor arranged for travel along a predetermined path, means for forming a continuous substantially flat initial layer of tobacco having a predetermined width on the conveyor, means for feeding a core having a width narrower than said predetermined width of said initial layer onto the initial layer of tobacco at a position along said path such that portions of said initial layer at opposite sides of said core are not covered by said core, side walls for at least partially confining the opposite sides of the core and extending downstream from said position along a predetermined portion of said path, and means for feeding further tobacco onto said side portions of the initial layer while the core is being confined by the side walls along said predetermined portion of said path to form a filler stream.

2. A cigarette making machine according to claim 1 in which the side walls are stationary walls spaced from the conveyor to allow the initial layer of tobacco to pass between the conveyor and the walls.

3. A cigarette making machine according to claim 2 in which each of said walls includes an edge nearest the conveyor and an edge remote from the conveyor, the edges of the walls remote from the conveyor converging in the downstream direction towards the edges of the walls nearest to the conveyor.

4. A cigarette making machine according to claim 1 in which said means for feeding said core comprises a wheel which is arranged to feed the core onto the initial layer of tobacco, said side walls being substantially radially projecting flange portions on said wheel.

5. A cigarette making machine according to claim 1 in which the initial layer forming means comprises means for showering tobacco onto the conveyor.

6. A cigarette making machine according to claim 1 in which the means for feeding tobacco onto said side portions of the initial layer comprises means for showering tobacco onto the side portions and over the core to surround the core with tobacco.

7. A cigarette making machine according to claim 1 further comprising means extending along said path adjacent opposite sides of said conveyor for confining the opposite sides of the tobacco on said conveyor.

8. A cigarette making machine according to claim 7 wherein said confining means comprises side rails at opposite sides of said conveyor terminating at a position along said path downstream of said further tobacco feeding means and a pair of spaced compression means located at opposite sides of said conveyor downstream of said position, the distance between said compression means being shorter than the distance between said side rails, for compressing the opposite sides of said filler stream to increase the density thereof as said filler stream is conveyed along said path between said pair of compression means.

9. A cigarette making machine according to claim 8 wherein said pair of compression means comprises a pair of wheels positioned at opposite sides of said filler stream respectively, the distance between the peripheral surfaces thereof being shorter than the distance between said side rails to contact and compress said filler stream.

10. A cigarette making machine for making cigarettes containing a core of material different from that of a surrounding annulus of tobacco, comprising a conveyor arranged for travel along a predetermined path; means for forming a continuous substantially flat initial layer of tobacco having a predetermined width on the conveyor; means for feeding a core having a width narrower than said predetermined width of said initial layer onto the initial layer of tobacco at a position along said path such that portions of said initial layer at opposite sides of said core are not covered by said core, and downstream from said position along said path for bending the initial layer of tobacco into a U-shaped cross-section at least partly around the core; and means for feeding further tobacco onto the initial layer and core to surround the core with tobacco.

11. A cigarette making machine for making cigarettes containing a core of material different from that of a surrounding annulus of tobacco, comprising a conveyor arranged for travel along a predetermined path, means for forming a continuous substantially flat initial layer of tobacco having a longitudinally extending middle portion of predetermined thickness on the conveyor, means at a position along said path for feeding a core having a width substantially the same as that of said middle portion of the initial layer onto the initial layer of tobacco, and for pressing the core into the middle portion of said initial layer of tobacco, so that the initial layer is deformed into a U-shaped cross-section which at least partly contains the core, the middle portion of said initial layer being thereby reduced in thickness, and means for feeding further tobacco onto the initial layer and core to surround the core with tobacco.

12. A cigarette making machine for making cigarettes containing a core of material different from that of a surrounding annulus of tobacco, comprising a suction wheel having an air-pervious peripheral portion of predetermined width with a central radially projecting peripheral rib, means, for feeding tobacco onto said peripheral portion of the wheel to form a continuous tobacco stream of predetermined width with a groove formed by said rib, a further conveyor for receiving the continuous tobacco stream from the wheel so that said groove formed in the tobacco stream by said rib is exposed, means for feeding a core having a width narrower than said predetermined width of said tobacco stream into the groove, and means for feeding further tobacco onto the tobacco stream and core to surround the core with tobacco.

13. A cigarette making machine according to claim 12 including a trimming device for trimming the tobacco stream formed on the suction wheel.

14. A cigarette making machine according to claim 12 in which the means for feeding tobacco onto the suction wheel comprises at least one other suction wheel and means for showering tobacco onto both said other suction wheel and said first suction wheel, said other suction wheel being arranged to transfer the tobacco to the first suction wheel.

* * * * *